US009472038B2

(12) United States Patent
Suetaka et al.

(10) Patent No.: US 9,472,038 B2
(45) Date of Patent: Oct. 18, 2016

(54) SHUTTER DEVICE AND MEDIUM TRANSACTION DEVICE

(71) Applicant: Oki Electric Industry Co., Ltd., Tokyo (JP)

(72) Inventors: Michio Suetaka, Tokyo (JP); Hajime Togiya, Tokyo (JP); Satoru Iwasaki, Tokyo (JP); Junpei Nagao, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/654,097

(22) PCT Filed: Nov. 11, 2013

(86) PCT No.: PCT/JP2013/080406

§ 371 (c)(1),
(2) Date: Jun. 19, 2015

(87) PCT Pub. No.: WO2014/103535

PCT Pub. Date: Jul. 3, 2014

(65) Prior Publication Data

US 2015/0317858 A1 Nov. 5, 2015

(30) Foreign Application Priority Data

Dec. 28, 2012 (JP) ..... 2012-287864

(51) Int. Cl.
*G07D 11/00* (2006.01)
*G07D 13/00* (2006.01)

(52) U.S. Cl.
CPC ..... *G07D 11/0018* (2013.01); *G07D 13/00* (2013.01)

(58) Field of Classification Search
CPC ..... G07D 11/0003; G07D 11/0018; G07D 11/0021; G07D 11/0024; G07D 11/009
USPC ..... 194/350, 351; 221/154; 49/279, 280, 49/281
See application file for complete search history.

(56) References Cited

U.S. PATENT DOCUMENTS

| | | | | |
|---|---|---|---|---|
| 5,172,643 | A | 12/1992 | Koshida et al. | |
| 2003/0121971 | A1* | 7/2003 | Lee | G06Q 20/1085 235/379 |
| 2004/0011619 | A1* | 1/2004 | Yoshioka | G07D 7/00 194/206 |

FOREIGN PATENT DOCUMENTS

| | | | |
|---|---|---|---|
| JP | 62-276686 | A | 12/1987 |
| JP | 04-174097 | A | 6/1992 |
| JP | 07-306969 | A | 11/1995 |
| JP | 09-091487 | A | 4/1997 |
| JP | 10-334305 | A | 12/1998 |
| JP | 4641776 | B2 | 3/2011 |
| WO | WO 2008-111148 | A1 | 9/2008 |

* cited by examiner

*Primary Examiner* — Mark Beauchaine
(74) *Attorney, Agent, or Firm* — Rabin & Berdo, P.C.

(57) ABSTRACT

A bill deposit/dispensing section has: an opening/closing section that moves a shutter in an opening direction and a closing direction; a driving section having driving force; a lock gear that serves as a gear section that drives the opening/closing section by transmitting driving force of the driving section to the opening/closing section by contacting the driving section and the opening/closing section and rotating; and a shutter locking/unlocking section that, by contacting the gear section and restricting rotation of the gear section, restricts operation of the opening/closing section and locks the shutter such that the shutter does not move, and, on the other hand, by coming apart from the gear section and freeing rotation of the gear section, releases locking so as to move the opening/closing section and move the shutter. Due thereto, a shutter device and media transaction device having improved security are provided.

10 Claims, 9 Drawing Sheets

SHUTTER DEVICE AND MEDIUM TRANSACTION DEVICE

TECHNICAL FIELD

The present invention relates to a shutter device and a media transaction device, and is suitable for application to, for example, an automatic cash transaction device (ATM) in which media such as bills or the like are inserted and that carries out a desired transaction, or the like.

BACKGROUND ART

Conventionally, a bill accommodating portion, that is box-shaped and is for the insertion of bills for deposit, and a shutter, that opens or closes the bill accommodating portion with respect to the exterior, are provided at a bill deposit/dispensing section of an automatic cash transaction device. At the time of a deposit, the shutter is opened, and bills that have been inserted into the bill accommodating portion by a user are taken-into the interior of the automatic cash transaction device, and deposit processing is carried out.

There are cases in which theft of the cash accommodated within the automatic cash transaction device is prevented by locking the shutter at the time of closing the bill accommodating portion with respect to the exterior at the bill deposit/dispensing section.

In such a bill deposit/dispensing section, a structure that directly locks the shutter or a link that is integral with the shutter (hereinafter called direct locking type) has been proposed (see, for example, Japanese Patent Application Laid-Open (JP-A) No. H4-174097, Japanese Patent No. 4641776, JP-A No. H9-91487).

As shown in FIG. 9, a direct locking type bill deposit/dispensing section 210 has a shutter 89 that is plate-shaped and that slides in a front-rear direction between an opening portion 88 of a frame 87 and a bill accommodating portion 22, a driving portion 90 that rotates clockwise or counterclockwise in the drawing, a cam portion 90A that projects-out from a place that is apart from the central axis of the driving portion 90, and a lock mechanism 92 that rotates clockwise or counterclockwise in the drawing around a supporting shaft 91 and whose rear end portion contacts the cam portion 90A from above.

At the time of closing the shutter 89, the bill deposit/dispensing section 210 moves the cam portion 90A downward by rotating the driving portion 90 counterclockwise. Therefore, the lock mechanism 92 rotates counterclockwise around the supporting shaft 91, and the front end contacts the rear end of the shutter 89. Due thereto, the shutter 89 is locked, and rearward movement thereof is restricted.

On the other hand, at the time of opening the shutter 89, the bill deposit/dispensing section 210 moves the cam portion 90A upward by rotating the driving portion 90 clockwise. Therefore, the lock mechanism 92 rotates clockwise around the supporting shaft 91, and the front end comes apart downward from the rear end of the shutter 89. Due thereto, locking of the shutter 89 is cancelled, and rearward movement thereof becomes possible.

DISCLOSURE OF INVENTION

Technical Problem

In this way, the direct locking type bill deposit/dispensing section makes the lock mechanism 92 directly contact and lock the shutter 89. Therefore, a lock anchoring position PL at which the lock mechanism 92 locks the shutter 89 must be provided in a vicinity of the shutter 89 (the point of contact of the lock mechanism 92 and the shutter 89).

In this case, there is the concern that anchoring of the lock will be cancelled by the insertion of a tool from the gap between the frame 87 and the shutter 89, and there is the concern that security is lacking.

The present invention was made in consideration of the above-described point, and proposes a shutter device and a media transaction device having improved security.

Solution to Problem

In order to overcome this problem, a shutter device of the present invention includes: an opening/closing section that moves a shutter in an opening direction of opening, to an exterior, a media accommodating portion, which accommodates media that have been taken from the exterior via an opening, and in a closing direction of closing the media accommodating portion off from the exterior; a driving section that has driving force; a gear section that drives the opening/closing section by transmitting driving force from the driving section to the opening/closing section by contacting the driving section and the opening/closing section and rotating; and a shutter locking/unlocking section that, by contacting the gear section and restricting rotation, restricts operation of the opening/closing section and locks the shutter that is in a closed state, and, on the other hand, by coming apart from the gear section, makes the opening/closing section able to operate and releases locking of the shutter.

At the shutter device, the shutter is not locked due to the shutter itself being contacted, and the shutter is locked due to the gear section, that drives the opening/closing section that opens/closes the shutter, being contacted. Due thereto, the lock anchoring position can be set apart from the opening.

Further, a media transaction device of the present invention comprises: a reception section that receives transactions relating to paper-sheet-like media; an opening/closing section that moves a shutter in an opening direction of opening, to an exterior, a media accommodating portion, which accommodates media that have been taken from the exterior via an opening, and in a closing direction of closing the media accommodating portion off from the exterior; a driving section that has driving force; a gear section that drives the opening/closing section by transmitting driving force from the driving section to the opening/closing section by contacting the driving section and the opening/closing section and rotating; a shutter locking/unlocking section that, by contacting the gear section and restricting rotation, restricts operation of the opening/closing section and locks the shutter that is in a closed state, and, on the other hand, by coming apart from the gear section, makes the opening/closing section able to operate and releases locking of the shutter; and a conveying section that conveys the media that were received by the reception section and accommodated in the media accommodating portion.

At the media transaction device, the shutter is not locked due to the shutter itself being contacted, and the shutter is locked due to the gear section, that drives the opening/closing section that opens/closes the shutter, being contacted. Due thereto, the lock anchoring position can be set apart from the opening.

Advantageous Effects of Invention

In accordance with the present invention, the shutter is not locked due to the shutter itself being contacted, and the shutter is locked due to the gear section, that drives the opening/closing section that opens/closes the shutter, being contacted. Due thereto, the lock anchoring position can be set apart from the opening. Thus, the present invention can realize a shutter device and a media transaction device having improved security.

BEST MODES FOR CARRYING OUT THE INVENTION

Embodiments for implementing the present invention (hereinafter called embodiments) are described hereinafter by using the drawings.

[1. First Embodiment]

[1-1. Overall Structure of Automatic Cash Transaction Device]

Figure 1:
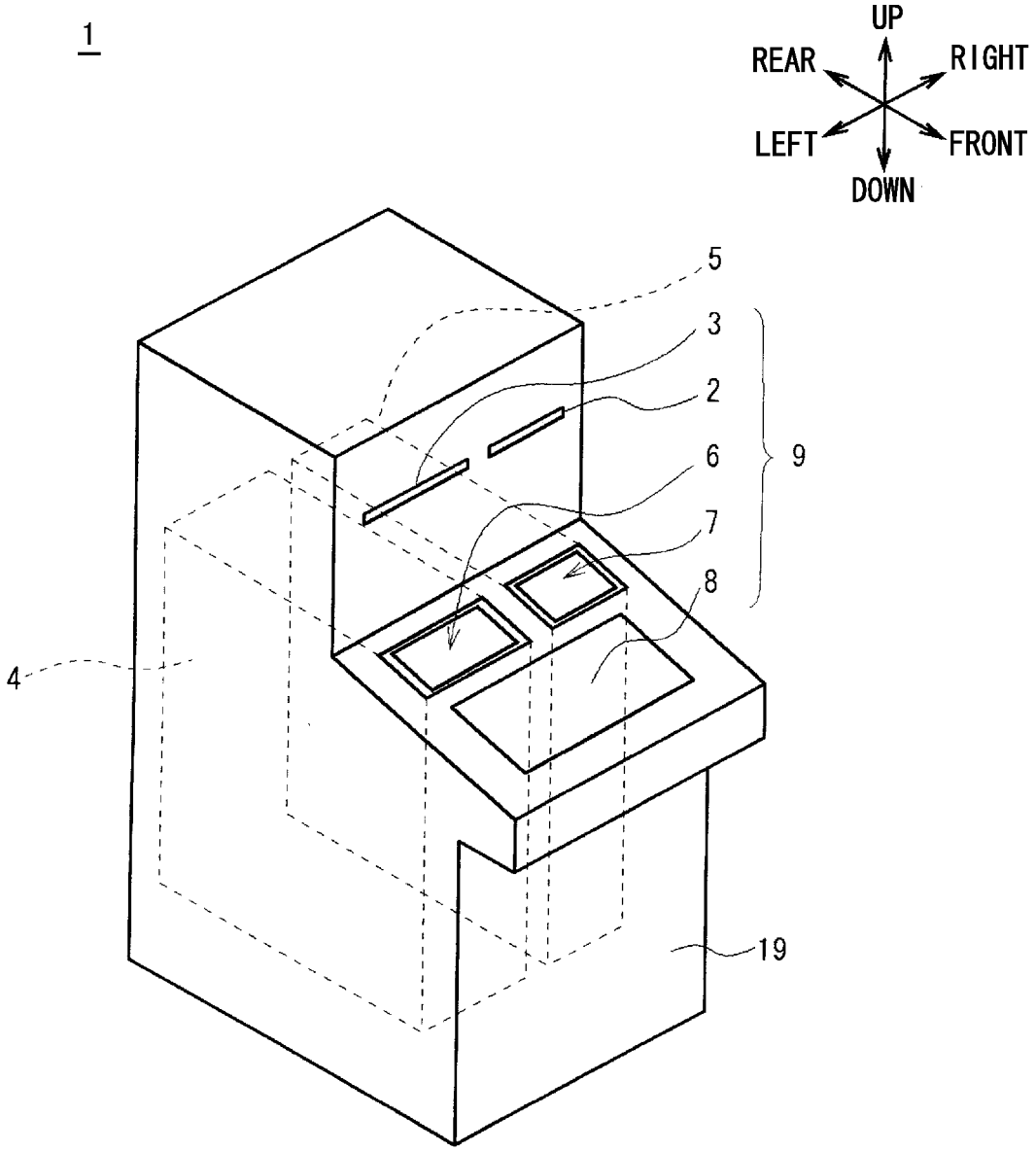
FIG. 1 is a perspective view showing the structure of an automatic cash transaction device.

As shown from the exterior in FIG. 1, an automatic cash transaction device 1 is structured around a housing 19 that is box-shaped, and is set in, for example, a financial institution or the like, and carries out transactions relating to cash such as deposit transactions and dispensing transactions and the like with users.

This automatic cash transaction device 1 uses a cash card, bills, a passbook, or the like as the transaction medium, and, in accordance with operation of a user, carries out processings such as deposits/withdrawals or payments of cash, fund transfers, and the like.

A customer interface section 9 is provided at the housing 19 at a place that is easy for bills to be inserted or a touch panel to be operated or the like in a state in which a user is facing the front side of the housing 19, i.e., at the upper portion of the front surface of the housing 19.

A card insertion/ejection opening 2, a passbook insertion/ejection opening 3, a bill insertion/ejection opening 6, a coin insertion/ejection opening 7, and a display/operation portion 8 are provided at the customer interface section 9. The customer interface section 9 directly exchanges cash, a passbook, or the like with a user, and carries out notifying of information relating to a transaction and receiving of operation instructions.

A card processing machine (not illustrated) that processes a cash card or the like of the user, and a passbook processing machine (not shown) that records the contents of a transaction and the like in a passbook, are provided at the upper portion of the interior of the automatic cash transaction device 1.

The card processing machine processes the cash card of the user that has been taken-in from the card insertion/ejection opening 2 provided at the front surface (the surface facing in the user) of the automatic cash transaction device 1. Further, the passbook processing machine processes the passbook that has been taken-in from the passbook insertion/ejection opening 3 provided at the front surface of the automatic cash transaction device 1.

Further, a bill deposit/dispensing machine 4 that processes bills, and a coin deposit/dispensing machine 5 that processes coins, are provided at the interior of the automatic cash transaction device 1.

The bill insertion/ejection opening 6, that is exposed at the front surface of the automatic cash transaction device 1, is provided at the front of the top surface of this bill deposit/dispensing machine 4, and the depositing and dispensing of bills are carried out via the bill/insertion ejection opening 6. Moreover, the coin insertion/ejection opening 7, that is exposed at the front surface of the automatic cash transaction device 1, is provided at the front of the top surface of the coin deposit/dispensing machine 5, and the depositing and dispensing of coins are carried out via the coin insertion/ejection opening 7.

Moreover, the display/operation portion 8 is provided at the near side of the bill insertion/ejection opening 6 and the coin insertion/ejection opening 7 at the automatic cash transaction device 1. This display/operation portion 8 is formed from, for example, a liquid crystal panel that serves as a display portion and a touch panel that serves as an operation portion, and can carry out the displaying of various types of screens, the input of the passcode and the amount to be transacted, and the like.

A control section (not shown) that controls the entirety is provided at a predetermined place within the housing 19 of the automatic cash transaction device 1.

[1-2. Structure of Bill Deposit/Dispensing Machine]

Figure 2:
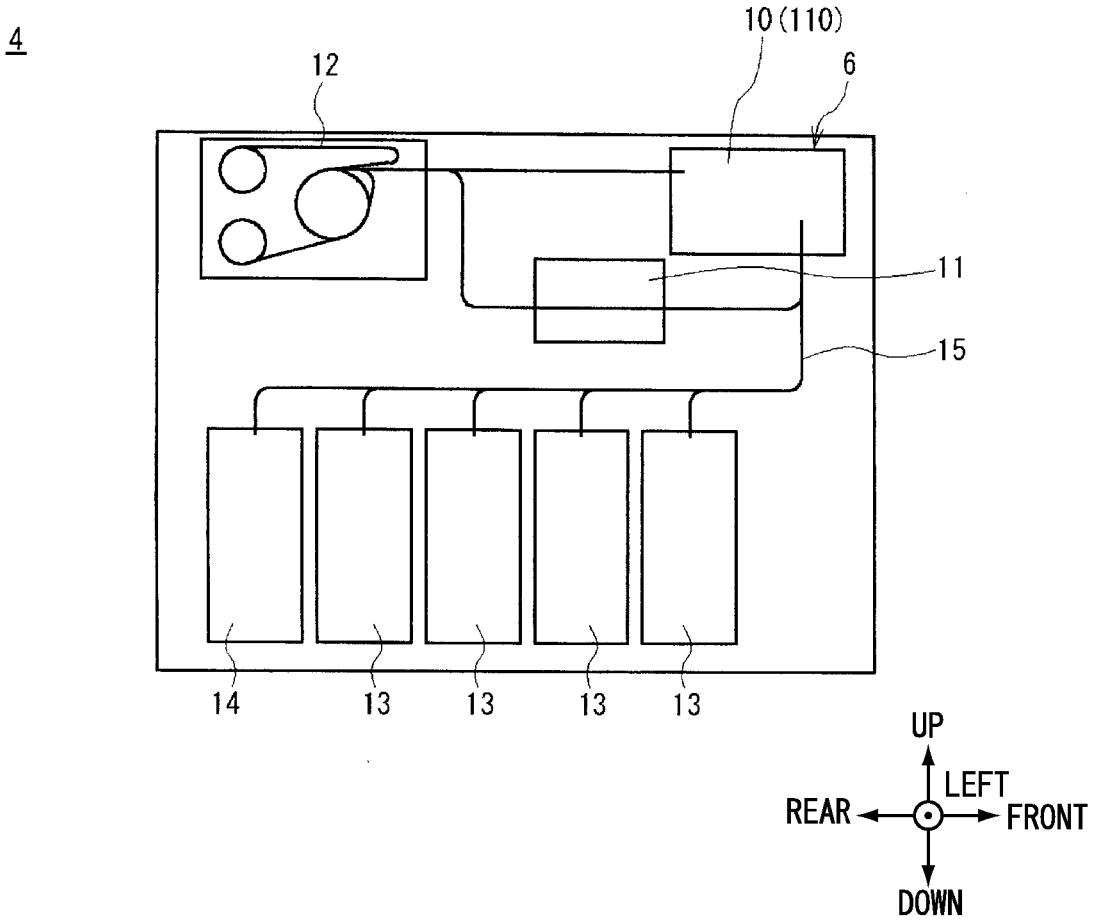
FIG. 2 is a left side view showing the structure of a bill deposit/dispensing machine.

As shown in FIG. 2, the bill deposit/dispensing machine 4 is a so-called recycling type bill deposit/dispensing machine that uses bills, that have been deposited, in dispensing as well. The bill deposit/dispensing machine 4 is structured such that a bill deposit/dispensing section 10, a discriminating section 11 and a temporary holding portion 12 are disposed at the upper portion, and plural bill storage depositories 13 and a reject depository 14 are disposed at the lower portion.

Concretely, the bill deposit/dispensing section 10 is disposed at the front surface side of the upper portion of the bill deposit/dispensing machine 4, and the aforementioned bill insertion/ejection opening 6 is provided at this bill deposit/dispensing section 10.

Further, at the upper portion of the bill deposit/dispensing machine 4, the discriminating section 11, that discriminates the authenticity, the undamaged/damaged state, the denomination, the conveyed state, and the like of bills, is disposed at a position that is rearward and downward of the bill deposit/dispensing section 10, and moreover, the temporary holding portion 12 that temporarily holds bills is disposed at a position that is rearward and upward of the discriminating section 11.

Moreover, at the lower portion of the bill deposit/dispensing machine 4, the plural bill storage depositories 13 that are vertically long are disposed so as to be lined-up in the front-rear direction, and moreover, the reject depository 14 is disposed at the rear of the tailmost bill storage depository 13.

A connecting path 15, that connects the bill deposit/dispensing section 10, the discriminating section 11, the temporary holding portion 12, the plural bill storage depositories 13 and the reject depository 14, is provided at this bill deposit/dispensing machine 4. Bills are conveyed to the respective sections through this conveying path 15.

At the bill deposit/dispensing machine 4 that has such a structure, at the time of a deposit transaction, when the user inserts bills in from the bill insertion/ejection opening 6 of the bill deposit/dispensing section 10, the bills are conveyed to the discriminating section 11. Bills that are judged to be normal bills by the discriminating section 11 are conveyed to and accommodated in the temporary holding portion 12. On the other hand, bills that are judged to be deposit reject bills, that are not suitable for depositing, are returned to the bill deposit/dispensing section 10, and are returned to the user from the bill insertion/ejection opening 6.

Thereafter, when the amount to be deposited is confirmed by the user, the bills that are accommodated in the temporary holding portion 12 are conveyed to the discriminating section 11, and the denominations are discriminated. Thereafter, the bills are conveyed to and stored in the respective bill storage depositories 13 in accordance with the denominations thereof.

On the other hand, at the time of a dispensing transaction, at the bill deposit/dispensing machine 4, when the amount to be dispensed is specified by the user, bills that correspond to the amount to be dispensed that has been specified are sent-out from the respective bill storage depositories 13 and are conveyed to the discriminating section 11. Then, the bill deposit/dispensing machine 4 conveys bills, that have been judged to be normal bills by the discriminating section 11, to the bill deposit/dispensing section 10, and, on the other hand, conveys and accommodates bills, that have been judged to be dispensing reject bills that are unsuitable for dispensing, to and in the temporary holding portion 12.

Thereafter, the bill deposit/dispensing machine 4 conveys the dispensing reject bills, that are accommodated in the temporary holding portion 12, to the reject depository 14 and stores them therein.

[1-3. Structure of Bill Deposit/Dispensing Section]

Figure 3:
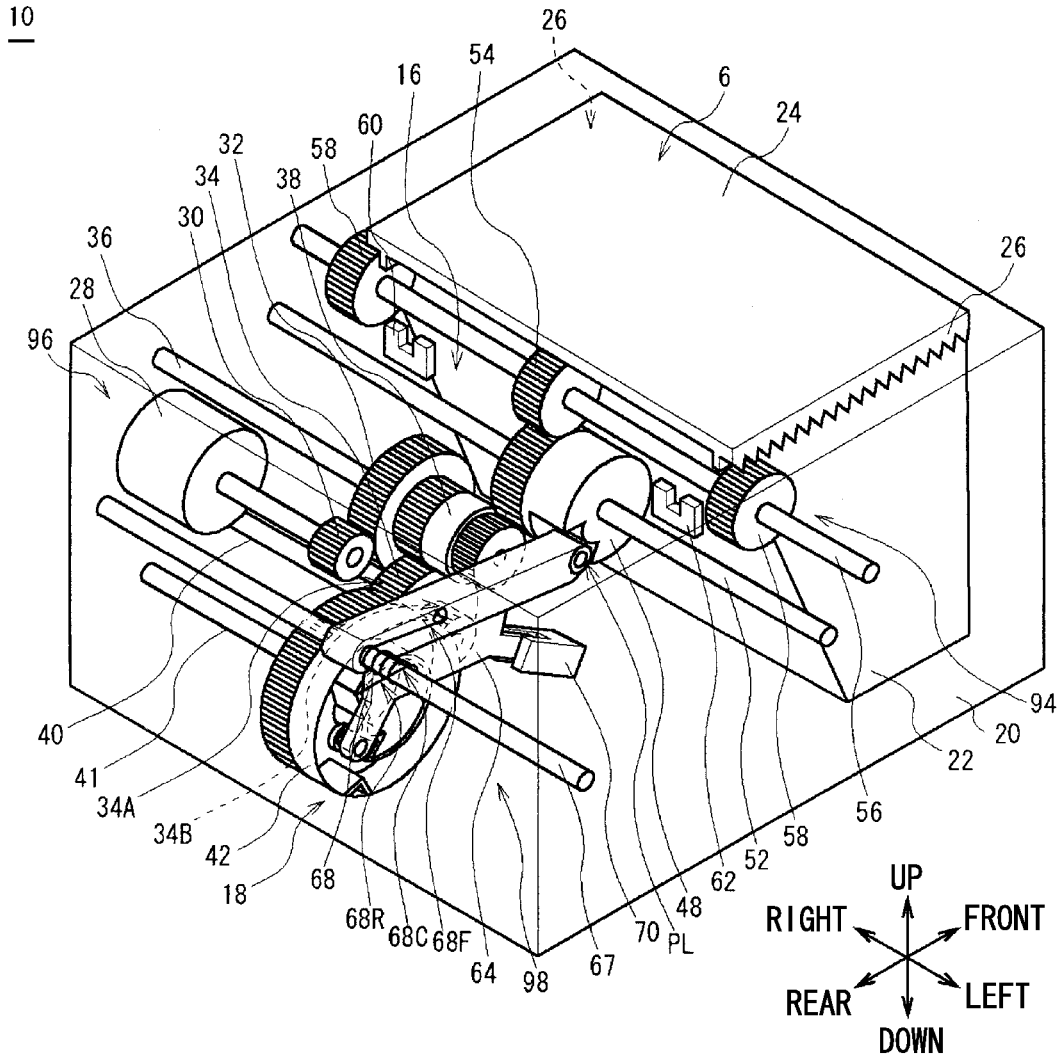
FIG. 3 is a perspective view showing the structure of a bill deposit/dispensing section in accordance with a first embodiment.

As shown from the exterior in FIG. 3, the bill deposit/dispensing section 10 is structured around a frame 20 that is box-shaped. The bill insertion/ejection opening 6 is provided in the front portion of the top of the frame 20.

Further, the bill accommodating portion 22, that is substantially U-shaped in cross-section and whose upper side is open and that accommodates bills in the interior thereof, is provided beneath the bill insertion/ejection opening 6.

A shutter 24 that is substantially plate-shaped is provided between the bill insertion/ejection opening 6 and the bill accommodating portion 22, so as to cover the bill insertion/ejection opening 6 from the lower side. Due to this shutter 24 moving in the front-rear direction, the shutter 24 opens or closes the bill accommodating portion 22 with respect to the exterior of the bill deposit/dispensing machine 4.

A shutter opening/closing mechanism 16 that opens and closes the shutter 24, and a shutter locking/unlocking mechanism 18 that performs locking so as to lock the shutter 24 and releases locking so as to unlock the shutter 24, are assembled in the bill deposit/dispensing section 10.

The shutter opening/closing mechanism 16 is structured mainly from a post two-stage gear 32, an idler gear 38, a lock gear 48, a drive gear 54 and pinion gears 58.

The shutter locking/unlocking mechanism 18 is structured mainly from the post two-stage gear 32, a two-stage gear 34, a cam gear 42, a lock portion 64 and the lock gear 48.

Shutter racks 26, in which grooves that are cut-out along the left-right direction are lined-up in the front-rear direction from the front end to the rear end of the shutter 24, are formed at the left and right end portions of the bottom surface of the shutter 24.

A motor 28, that generates driving force clockwise and counterclockwise as seen in side view, is mounted to the frame 20 further toward the rear than the shutter 24.

A motor gear 30 that is cylindrical is mounted to the left end of the motor 28 so as to rotate in accordance with the rotation of the motor 28 as seen in side view.

In front of the motor gear 30, the post two-stage gear 32 is mounted to the frame 20 so as to rotate freely around a post two-stage gear shaft 36 as seen in side view, so as to mesh-together with the motor gear 30.

Figure 4:
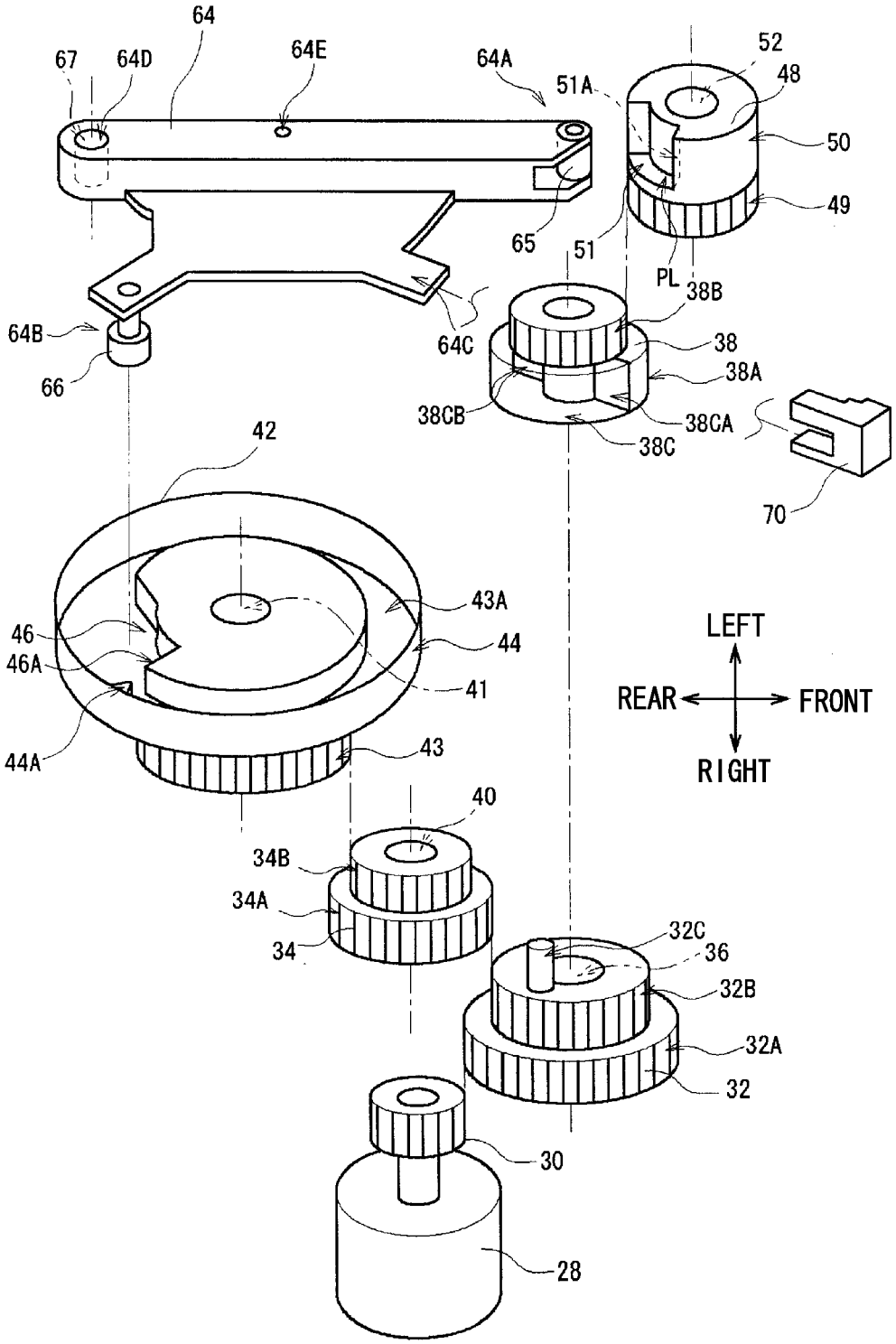
FIG. 4 is a perspective view showing the structures of a post two-stage gear, an idler gear, a cam gear, a lock portion, and a lock gear.

As shown in FIG. 4, the post two-stage gear 32 is structured from a large-diameter post two-stage gear portion 32A, that is cylindrical and at whose outer peripheral surface gear teeth are formed, and a small-diameter post two-stage gear portion 32B, that is formed at the left side of the large-diameter post two-stage gear portion 32A and that is cylindrical and has a smaller diameter than that of the large-diameter post two-stage gear portion 32A and at whose outer peripheral surface gear teeth are formed.

A post portion 32C that is cylindrical projects-out toward the left side from the left side surface of the small-diameter post two-stage gear portion 32B.

Rotational driving force from the motor 28 is transmitted to the post two-stage gear 32 due to the large-diameter post two-stage gear portion 32A meshing-together with the motor gear 30.

Further, due to the post two-stage gear 32 having the small-diameter post two-stage gear portion 32B whose diameter is smaller than that of the large-diameter post two-stage gear portion 32A, the post two-stage gear 32 decelerates and transmits the rotational driving force from the motor 28 to the two-stage gear 34 (described later) that meshes-together with this small-diameter post two-stage gear portion 32B. Hereinafter, the diameter of a gear, at whose outer peripheral surface gear teeth are formed, is also called the gear diameter.

The idler gear 38, that rotates freely around the same post two-stage gear shaft 36 as the post two-stage gear 32, is provided at the left side of the post two-stage gear 32.

As shown in FIG. 4, the idler gear 38 is structured from a large-diameter portion 38A that is cylindrical, and an idler gear portion 38B that is formed at the left side of the large-diameter portion 38A and is cylindrical and whose diameter is smaller than that of the large-diameter portion 38A and at whose outer peripheral surface gear teeth are formed.

At the right side surface, that faces the post portion 32C of the post two-stage gear 32, of the large-diameter portion 38A, an arc-shaped long hole portion 38C that is centered around the post two-stage gear shaft 36 is recessed in an arc shape over substantially half of the circumference, and the post portion 32C is slidably fit therein.

A closed-time abutment end surface 38CB that is the distal end side in the clockwise rotational direction as seen in side view, and an open-time abutment end surface 38CA that is the distal end side in the counterclockwise rotational direction, are formed at the arc-shaped long hole portion 38C.

By the post two-stage gear 32 and the idler gear 38, the bill deposit/dispensing section 10 delays the timing at which rotation from the motor 28 is transmitted to the pinion gears 58 (details are described later).

At the rear of and the lower side of the post two-stage gear 32, the two-stage gear 34 is mounted to the frame 20 so as to rotate freely around a two-stage gear shaft 40 as seen in side view, so as to mesh-together with the post two-stage gear 32.

The two-stage gear 34 is structured from a large-diameter two-stage gear portion 34A that is cylindrical and at whose outer peripheral surface gear teeth are formed, and a small-diameter two-stage gear portion 34B that is formed at the left side of the large-diameter two-stage gear portion 34A and is cylindrical and whose gear diameter is smaller than that of the large-diameter two-stage gear portion 34A and at whose outer peripheral surface gear teeth are formed.

Rotational driving force from the motor 28 is transmitted to the two-stage gear 34 due to the large-diameter two-stage gear portion 34A meshing-together with the small-diameter post two-stage gear portion 32B of the post two-stage gear 32.

Further, due to the two-stage gear 34 having the small-diameter two-stage gear portion 34B whose gear diameter is smaller than that of the large-diameter two-stage gear portion 34A, the two-stage gear 34 decelerates and transmits rotational driving force from the motor 28 to the cam gear 42 (described later) that meshes-together with this small-diameter two-stage gear portion 34B.

Concretely, the two-stage gear 34 decelerates rotation from the post two-stage gear 32, and converts rotation of the cam gear 42, that corresponds to one opening and closing of the shutter 24, into less than one full rotation. In this way, at the bill deposit/dispensing section 10, the respective types of gears of the shutter opening/closing mechanism 16 and the shutter locking/unlocking mechanism 18 are structured at a gear ratio at which the cam gear 42 rotates approximately one time at the time when the shutter 24 moves from the open state to the closed state.

At the rear of the two-stage gear 34, the cam gear 42 is mounted to the frame 20 so as to rotate freely around a cam gear shaft 41 as seen in side view, so as to mesh-together with the two-stage gear 34.

As shown in FIG. 4, the cam gear 42 has a cam gear portion 43 that is cylindrical and at whose outer peripheral surface gear teeth are formed.

Rotational driving force from the motor 28 is transmitted to the cam gear 42 due to the cam gear portion 43 meshing-together with the small-diameter two-stage gear portion 34B of the two-stage gear 34.

At the left side of the cam gear portion 43, at an outer peripheral wall that stands erect toward the left along the outer periphery of a bottom surface 43A that is disc-shaped, an operation portion 44, at which a groove that is carved along the left-right direction is formed in the outer peripheral surface of this outer peripheral wall, is formed.

Therefore, at the time of maintenance work, a worker can rotate the cam gear 42 while touching the operation portion 44.

Further, at the inner peripheral side of the operation portion 44, a cam portion 45 that is disc-shaped stands erect toward the left from the bottom surface 43A.

A releasing link sliding portion 46, at which approximately ¼ of the circumference of the substantially circular shape of the cam portion 45 is recessed toward the cam gear shaft 41, is formed at the cam portion 45.

A reverse rotation preventing end surface 46A, that is a flat surface that is directed from the outer peripheral surface of the cam portion 45 toward the cam gear shaft 41, is formed at the distal end side in the counterclockwise rotational direction as seen in side view at the releasing link sliding portion 46.

Further, a projecting portion 44A, that projects-out toward the cam gear shaft 41, is formed at the operation portion 44 at a place that faces the reverse rotation preventing end surface 46A of the cam portion 45.

By the way, in front of and above the idler gear 38 (see FIG. 3), the lock gear 48 that is cylindrical is provided so as to be able to rotate freely around a lock gear shaft 52 as seen in side view, so as to mesh-together with the idler gear 38. The left and right both ends of the lock gear shaft 52 are fixed to the frame 20.

As shown in FIG. 4, the lock gear 48 is structured from a lock gear portion 49 that is cylindrical and at whose outer peripheral surface gear teeth are formed, and a lock anchor portion 50 that is formed at a side surface portion of the lock gear portion 49.

Rotational driving force from the motor 28 is transmitted to the lock gear 48 due to the lock gear portion 49 meshing-together with the idler gear portion 38B of the idler gear 38.

Further, a lock anchor sliding portion 51, at which approximately ¼ of the circumference of the lock anchor portion 50 is cut-out in an arc shape, is carved into the lock anchor portion 50.

A lock end surface 51A, that is a flat surface that goes from the outer peripheral surface of the lock anchor portion 50 toward the rotational center of the lock gear shaft 52, is formed at the distal end side in the counterclockwise rotational direction as seen in side view at the lock anchor sliding portion 51.

In front of and above the lock gear 48, the drive gear 54, that is cylindrical and at whose outer peripheral surface gear teeth are formed and whose gear diameter is smaller than that of the lock gear portion 49 of the lock gear 48, has a drive gear shaft 56 inserted therethrough and fixed thereto such that the drive gear 54 meshes-together with the lock gear 48, and the drive gear 54 is provided so as to rotate together with the drive gear shaft 56 as seen in side view. The left and right both ends of the drive gear shaft 56 are rotatably fixed to the frame 20.

Rotational driving force from the motor 28 is transmitted to the drive gear 54 due to the drive gear 54 meshing-together with the lock gear portion 49 of the lock gear 48.

The pinion gears 58, that are cylindrical and at whose outer peripheral surfaces gear teeth are formed and whose gear diameter is slightly larger than that of the drive gear 54, are fixed to the left and right both ends of the drive gear shaft 56 such that the phases of the gear teeth thereof match.

Due to the pinion gears 58 meshing-together with the shutter racks 26 that are at the shutter 24 that is above, the rotational driving force of the pinion gears 58 is converted into rectilinear motion in the front-rear direction of the shutter 24 and is transmitted thereto.

An opened sensing sensor 60 and a closed sensing sensor 62 that are fixed to the frame 20 are provided beneath vicinities of the rear end of the shutter 24.

In the state in which the shutter 24 is completely open, the opened sensing sensor 60 senses the open state by detecting the absence/presence of an unillustrated open-time blocking portion that is provided at the shutter 24.

Further, in the state in which the shutter 24 is completely closed, the closed sensing sensor 62 senses the closed state by detecting the absence/presence of an unillustrated closed-time blocking portion that is provided at the shutter 24.

By the way, the lock portion 64 is provided at the left side of the cam gear 42 and the lock gear 48.

Due to a rotation fulcrum shaft 67 that is cylindrical being inserted through a shaft hole portion 64D that is formed in the rear end of the upper portion of the lock portion 64, the lock portion 64 rotates clockwise and counterclockwise as seen in side view with the rotation fulcrum shaft 67 being the fulcrum.

A lock anchor projecting portion 64A is formed at the front end of the lock portion 64. A lock rotating member 65, that is cylindrical and is a rotatable roller or bearing or the like, is provided at this lock anchor projecting portion 64A. This lock rotating member 65 rotates while being inserted-in and contacting the lock anchor sliding portion 51 of the lock gear 48.

A lock releasing link portion 64B is formed at the rear end of the lower portion of the lock portion 64. A lock releasing rotating member 66, that is substantially cylindrical and is a rotatable roller or bearing or the like, is provided at this lock releasing link portion 64B. This lock releasing rotating member 66 rotates while being inserted-in and contacting the releasing link sliding portion 46 of the cam gear 42.

A blocking portion 64C that projects-out toward the front is formed at the front end of the lower portion of the lock portion 64.

A locked state sensing sensor 70 that is fixed to the frame 20 is provided in a vicinity of the blocking portion 64C of the lock portion 64. The locked state sensing sensor 70 senses the locked state by detecting whether or not the blocking portion 64C of the lock portion 64 has blocked a detection portion.

A wound portion 68C, that is the central portion in the front-rear direction of a single metal rod at a spring 68 that is a torsion bar spring, is wound around the rotating fulcrum shaft 67 (FIG. 3) at the left side of the lock portion 64.

A front arm portion 68F that is a portion of the torsion bar spring extends in the frontward direction from the wound portion 68C, and a rear arm portion 68R extends in the rearward direction, respectively.

In the state in which the front end portion of the front arm portion 68F is positioned further downward than the natural state, the spring 68 is fit into a spring hole portion 64E that is formed between the shaft hole portion 64D and the lock anchor projecting portion 64A at the lock portion 64, and, in the state in which the rear end portion of the rear arm portion 68R is positioned further downward than the natural state, the spring 68 is fixed to the frame 20.

Therefore, the lock portion 64 is urged by the spring 68 so as to rotate counterclockwise as seen in side view.

The bill deposit/dispensing section 10 is structured such that the phases of the gear teeth of these motor gear 30, two-stage gear 34, cam gear 42, post two-stage gear 32, idler gear 38, lock gear 48, drive gear 54 and pinion gears 58 match, in order to make the amount of backlash of locking in the closed state uniform.

Hereinafter, the drive gear 54, the drive gear shaft 56 and the pinion gears 58, that are the mechanism that moves the shutter 24 in the opening direction and the closing direction, are collectively called an opening/closing section 94. The motor 28, the motor gear 30, the post two-stage gear 32, the idler gear 38 and the two-stage gear 34, that are the mechanism that has rotational driving force, are collectively called a driving section 96. The cam gear 42 and the lock portion 64, that transmit the driving force of the driving section 96 to the opening/closing section 94 by contacting the driving section 96 and the opening/closing section 94 and rotating, are collectively also called the shutter locking/unlocking section 98.

[1-4. Operation and Effects]

[1-4-1. Locked State in Closed State]

Figure 5:
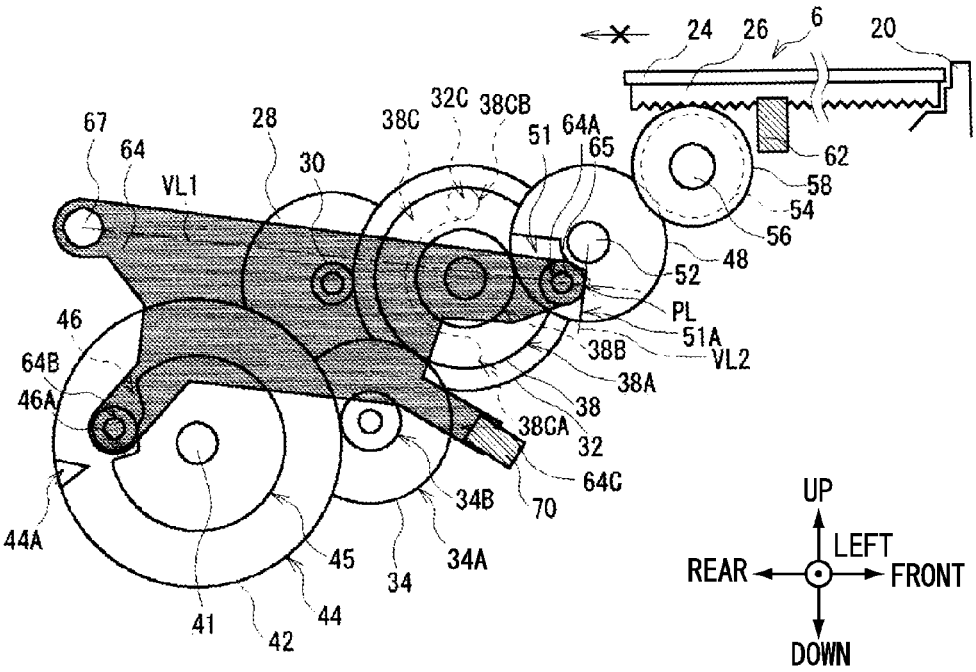
FIG. 5 is a left side view showing a locked state in a closed state of the bill deposit/dispensing section in accordance with the first embodiment.

In the above-described structure, as shown in FIG. 5, in the locked state of the closed state, it is sensed that the bill deposit/dispensing section 10 is in a locked state due to the blocking portion 64C of the lock portion 64 being positioned so as to block the locked state sensing sensor 70.

The post portion 32C of the post two-stage gear 32 abuts the closed-time abutment end surface 38CB of the arc-shaped long hole portion 38C of the idler gear 38.

Further, the lock anchor projecting portion 64A of the lock portion 64 abuts the lock end surface 51A of the lock anchor sliding portion 51 of the lock gear 48.

Further, the lock releasing link portion 64B of the lock portion 64 does not abut the reverse rotation preventing end surface 46A at the cam portion 45 of the cam gear 42, and is set slightly apart therefrom.

In this way, in the closed state, the reverse rotation preventing end surface 46A of the cam portion 45 is positioned in a vicinity of the distal end side in the counter-clockwise rotation direction with respect to the lock releasing link portion 64B of the lock portion 64. Therefore, in the closed state, the reverse rotation preventing end surface 46A can prevent the cam gear 42 from rotating clockwise.

In this state, when force in the opening direction (rearward) is applied to the shutter 24 (i.e., when at attempt is made to forcibly open the shutter 24 in the locked state in the closed state), this force attempts to rotate the lock gear 48 clockwise in FIG. 5 via the pinion gears 58, the drive gear shaft 56 and the drive gear 54.

At this time, clockwise rotation (rotation in the direction of opening the shutter 24) is prevented due to the lock end surface 51A of the lock gear 48 abutting the lock anchor projecting portion 64A of the lock portion 64.

In this way, in the locked state, at the bill deposit/dispensing section 10, the shutter 24 can be prevented from being opened due to the lock portion 64 restricting clockwise rotation of the lock gear 48.

Further, in the closed state, the angle between virtual line VL1, that passes through the rotational center of the rotating fulcrum shaft 67 and the rotational center of the lock rotating member 65 at the lock anchor projecting portion 64A, and virtual line VL2, that passes through a plane that runs along the lock end surface 51A of the lock anchor sliding portion 51 and through the rotational center of the lock gear shaft 52, is 90°.

If the angle between the virtual line VL1 and the virtual line VL2 were to be greater than 90°, if the lock gear 48 were to start to rotate clockwise in FIG. 5, there is the possibility that the lock anchor projecting portion 64A of the lock portion 64 would move in the downward direction from the lock end surface 51A and would withdraw from the lock anchor sliding portion 51, and locking would be cancelled in the locked state.

On the other hand, if the angle between the virtual line VL1 and the virtual line VL2 were to be less than 90°, there is the possibility that, at the time of transitioning to a lock-free state that is described later, the lock portion 64 would not be able to rotate clockwise in FIG. 5, and locking could not be released.

In contrast, at the bill deposit/dispensing section 10, by making the angle between the virtual line VL1 and the virtual line VL2 be 90°, the shutter 24 is prevented from being opened in the locked state in the closed state, and, at the time of opening the shutter 24 from the closed state, the bill deposit/dispensing section 10 can transition to the lock-free state that is described later.

[1-4-2. Transition from Locked State in Closed State to Lock-free State]

Figure 6:
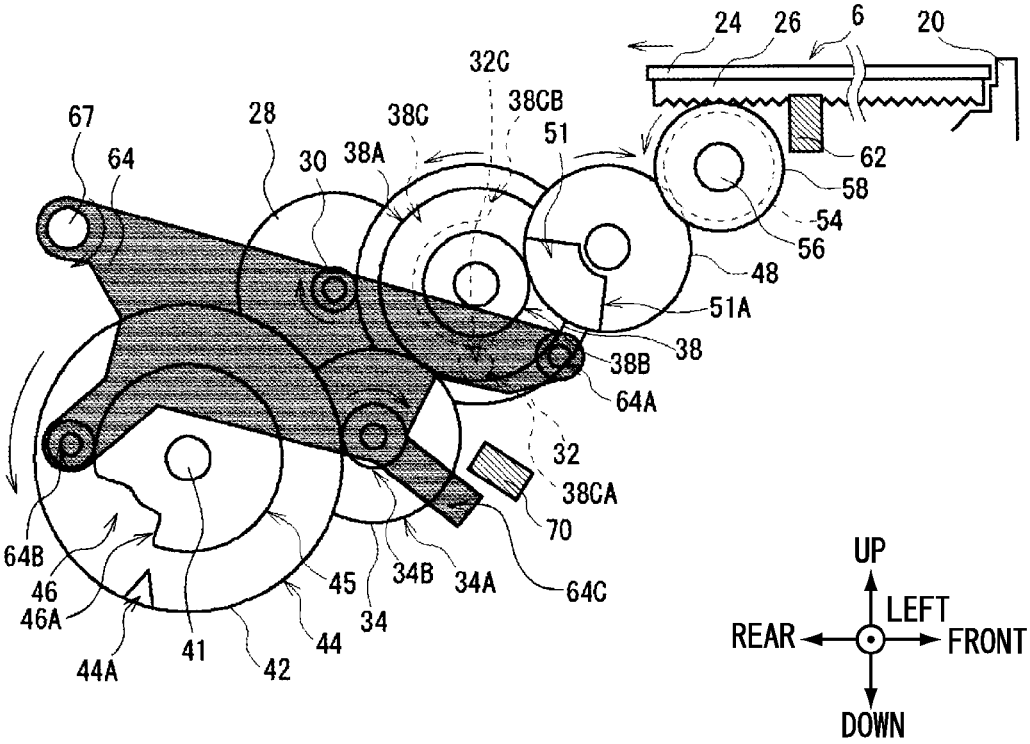
FIG. 6 is a left side view showing a lock-free state in the closed state of the bill deposit/dispensing section in accordance with the first embodiment.

At the time of opening the shutter 24 from the locked state in the closed state, as shown in FIG. 6, the bill deposit/dispensing section 10 rotates the motor 28 clockwise on the basis of control of the control section. This rotational driving force is successively transmitted, and the post two-stage gear 32 rotates counterclockwise, and the two-stage gear 34 rotates clockwise, respectively, and the cam gear 42 rotates counterclockwise.

At this time, the lock releasing link portion 64B of the lock portion 64 rollingly moves while abutting the releasing link sliding portion 46 at the cam portion 45 of the cam gear 42, and thereafter, rides-up on the outer peripheral surface of the cam portion 45. Due thereto, the lock releasing link portion 64B moves rearward, and the distance from the cam gear shaft 41 (hereinafter also called cam diameter CR) increases.

Therefore, the lock portion 64 rotates clockwise against the urging force of the spring 68 (FIG. 3) and around the rotation fulcrum shaft 67.

Due thereto, the lock anchor projecting portion 64A of the lock portion 64 moves in the downward direction from the lock end surface 51A of the lock gear 48, and withdraws from the lock anchor sliding portion 51.

At this time, due to the blocking portion 64C of the lock portion 64 moving further rearward and downward than the locked state sensing sensor 70, the bill deposit/dispensing section 10 senses a lock-free state in which locking has been released.

[1-4-3. Transition from Lock-free State in Closed State to Open State]

When, from the lock-free state in the closed state that is shown in FIG. 6, the post two-stage gear 32 rotates counterclockwise due to the motor 28 rotating clockwise further, the post portion 32C at this post two-stage gear 32 moves along the arc-shaped long hole portion 38C of the idler gear 38 and abuts the open-time abutment end surface 38CA.

Therefore, due to the post portion 32C pushing the open-time abutment end surface 38CA of the arc-shaped long hole portion 38C counterclockwise, rotational driving force is transmitted from the post two-stage gear 32 to the idler gear 38.

When the idler gear 38 rotates counterclockwise, the lock gear 48, from which the lock anchor projecting portion 64A of the lock portion 64 has come apart, rotates clockwise.

Figure 7:
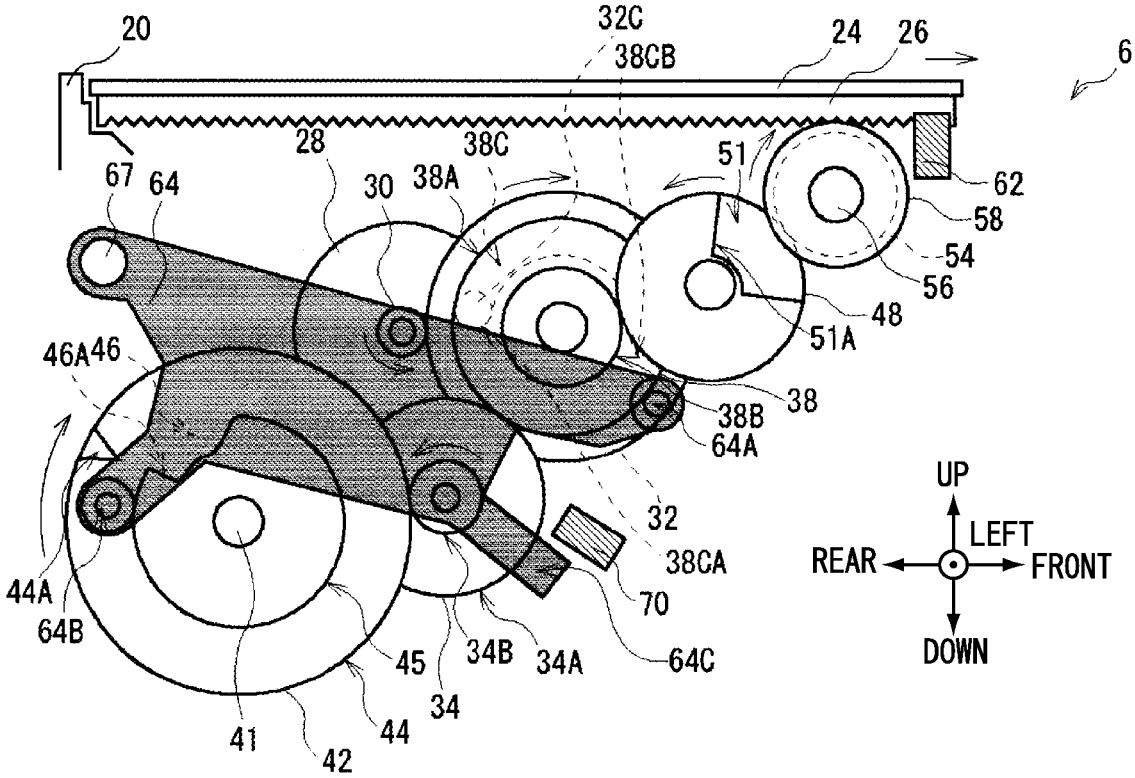
FIG. 7 is a left side view showing an open state of the bill deposit/dispensing section in accordance with the first embodiment.

When the lock gear 48 rotates clockwise, the rotational driving force thereof is successively transmitted, and, due to the drive gear 54, the drive gear shaft 56 and the pinion gears 58 respectively rotating counterclockwise, the shutter 24 moves in the opening direction, and the shutter 24 enters into the open state as shown in FIG. 7.

In the open state, the projecting portion 44A of the cam gear 42 is positioned in a vicinity of the distal end side in the clockwise rotational direction with respect to the lock releasing link portion 64B of the lock portion 64. Therefore, at the time of the transition from the closed state to the open state, the projecting portion 44A can prevent the lock releasing link portion 64B from entering into the releasing link sliding portion 46.

Due thereto, the bill deposit/dispensing section 10 prevents rotation of greater than or equal to one rotation of the cam gear 42, and it can be made such that the phases of the gear teeth of the two-stage gear 34, the cam gear 42, the post two-stage gear 32, the idler gear 38, the lock gear 48, the drive gear 54 and the pinion gears 58 do not become offset.

[1-4-4. Transition from Open State to Closed State]

In the open state, due to the lock anchor projecting portion 64A of the lock portion 64 being positioned further toward the lower side than the lock end surface 51A of the lock gear 48, the lock anchor projecting portion 64A is withdrawn from the lock anchor portion 50, and the bill deposit/dispensing section 10 is in the lock-free state.

At the time of closing the shutter 24 from the open state, the bill deposit/dispensing section 10 rotates the motor 28 counterclockwise on the basis of control of the control section. This rotational driving force is successively transmitted, and the post two-stage gear 32 rotates clockwise, and the two-stage gear 34 rotates counterclockwise, respectively, and the cam gear 42 rotates clockwise.

At this time, due to the lock portion 64 rollingly moving the lock releasing link portion 64B along the outer peripheral surface of the cam portion 45 of the cam gear 42 while the cam diameter CR remains constant, the state in which the lock anchor projecting portion 64A is withdrawn from the lock anchor sliding portion 51 of the lock gear 48 is maintained.

Further, at this time, when the post portion 32C of the post two-stage gear 32 moves along the arc-shaped long hole portion 38C of the idler gear 38 and rotates clockwise by a predetermined angle or more, the post portion 32C abuts the closed-time abutment end surface 38CB.

Therefore, due to the post portion 32C pushing the closed-time abutment end surface 38CB of the arc-shaped long hole portion 38C clockwise, rotational driving force is transmitted from the post two-stage gear 32 to the idler gear 38.

When the idler gear 38 rotates clockwise, the rotational driving force thereof is transmitted successively, and the lock gear 48 rotates counterclockwise, and the drive gear 54, the drive gear shaft 56 and the pinion gears 58 rotate clockwise, respectively. Due thereto, the shutter 24 starts to move in the closing direction (forward).

Due to the motor 28 continuing to rotate counterclockwise, the cam gear 42 rotates clockwise until the lock releasing link portion 64B of the lock portion 64 is positioned at the boundary between the outer peripheral surface of the cam portion 45 and the releasing link sliding portion 46 (i.e., until the cam diameter CR starts to become smaller).

At this time, due to the lock portion 64 rollingly moving the lock anchor projecting portion 64A along the outer peripheral surface of the lock anchor portion 50 of the lock gear 48, the state in which the lock anchor projecting portion 64A is withdrawn from the lock anchor sliding portion 51 of the lock gear 48 is maintained.

In this state, the blocking portion 64C of the lock portion 64 remains positioned as is further toward the lower rear side than the locked state sensing sensor 70, and therefore, the bill deposit/dispensing section 10 senses the lock-free state.

Immediately before the shutter 24 enters into the closed state in which it is completely closed, the lock anchor projecting portion 64A of the lock portion 64 rollingly moves while abutting the lock end surface 51A of the lock anchor sliding portion 51 of the lock gear 48 that rotates counterclockwise, and the lock anchor projecting portion 64A enters into the lock anchor sliding portion 51.

Therefore, the lock portion 64 rotates counterclockwise around the rotation fulcrum shaft 67 due to the urging force of the spring 68.

Due thereto, the lock anchor projecting portion 64A of the lock portion 64 abuts the lock end surface 51 A of the lock anchor portion 50 of the lock gear 48, and enters into the locked state as shown in FIG. 5.

At this time, the lock releasing link portion 64B is positioned so as to be slightly apart from the reverse rotation preventing end surface 46A at the cam portion 45 of the cam gear 42.

Further, at this time, due to the blocking portion 64C of the lock portion 64 moving forward and upward and being positioned so as to block the locked state sensing sensor 70, the bill deposit/dispensing section 10 senses the locked state.

In this way, the bill deposit/dispensing section 10 transmits driving force to the shutter opening/closing mechanism 16 and the shutter locking/unlocking mechanism 18 from the motor 28 that is the same drive source, and opens and closes the shutter 24 and carries out locking and unlocking of the shutter 24.

[1-4-5. Results]

In the above-described structure, the bill deposit/dispensing section 10 does not directly contact and lock the shutter 24, but locks the shutter 24 by restricting, by the lock portion 64, the rotation of the lock gear 48 that transmits rotational driving force to the drive gear 54, the drive gear shaft 56 and the pinion gears 58 that carry out the driving for opening and closing the shutter 24.

Figure 9:
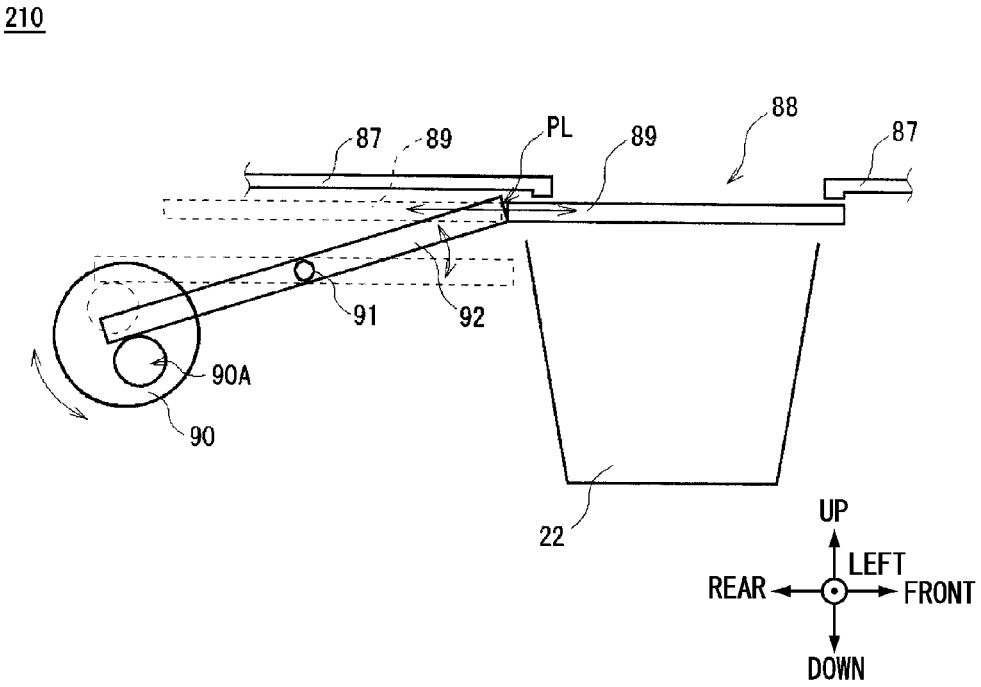
FIG. 9 is a left side view showing the structure of a conventional bill deposit/dispensing section.

Therefore, as compared with the conventional bill deposit/dispensing section 210 (FIG. 9), the bill deposit/dispensing section 10 can set the lock anchoring position PL (the point of contact of the lock portion 64 and the lock gear 48), at which the shutter 24 is locked, apart from the bill insertion/ejection opening 6 and the shutter 24.

Due thereto, the bill deposit/dispensing section 10 can make it difficult to insert a tool in between the shutter 24 and the frame from the exterior and access the lock anchoring position PL, and makes unlocking from the exterior difficult, and can prevent improper unlocking activity.

Further, at the bill deposit/dispensing section 10, due to the operation portion 44 being provided at the cam gear 42, a worker can rotate the can gear 42 while touching the operation portion 44 at the time of maintenance work, and can manually unlock and lock the shutter 24.

In the above-described structure, the bill deposit/dispensing section 10 includes: the opening/closing section 94 that moves the shutter 24 in an opening direction of opening, to an exterior, the bill accommodating portion 22, that accommodates bills that have been taken-in from the exterior via the bill insertion/ejection opening 6, and in a closing direction of closing the bill accommodating portion 22 off from the exterior; the driving section 96 that has driving force; the lock gear 48 that serves as the gear section that drives the opening/closing section 94 by transmitting driving force from the driving section 96 to the opening/closing section 94 by contacting the driving section 96 and the opening/closing section 94 and rotating; and the shutter locking/unlocking section 96 that, by contacting the gear section and restricting rotation of the gear section, restricts operation of the opening/closing section 94 and locks the shutter 24 such that the shutter 24 does not move, and, on the other hand, by coming apart from the gear section and freeing rotation of the gear section, releases locking so as to move the opening/closing section 94 and move the shutter 24.

Therefore, at the bill deposit/dispensing section 10, the shutter 24 is not locked by contacting of the shutter 24 itself, and the shutter 24 is locked by contacting of the lock gear 48 that drives the pinion gears 58 that open and close the shutter 24. Due thereto, the lock anchoring position PL is set apart from the shutter 24, and unlocking from the exterior can be made to be difficult.

[2. Second Embodiment]

Figure 8:
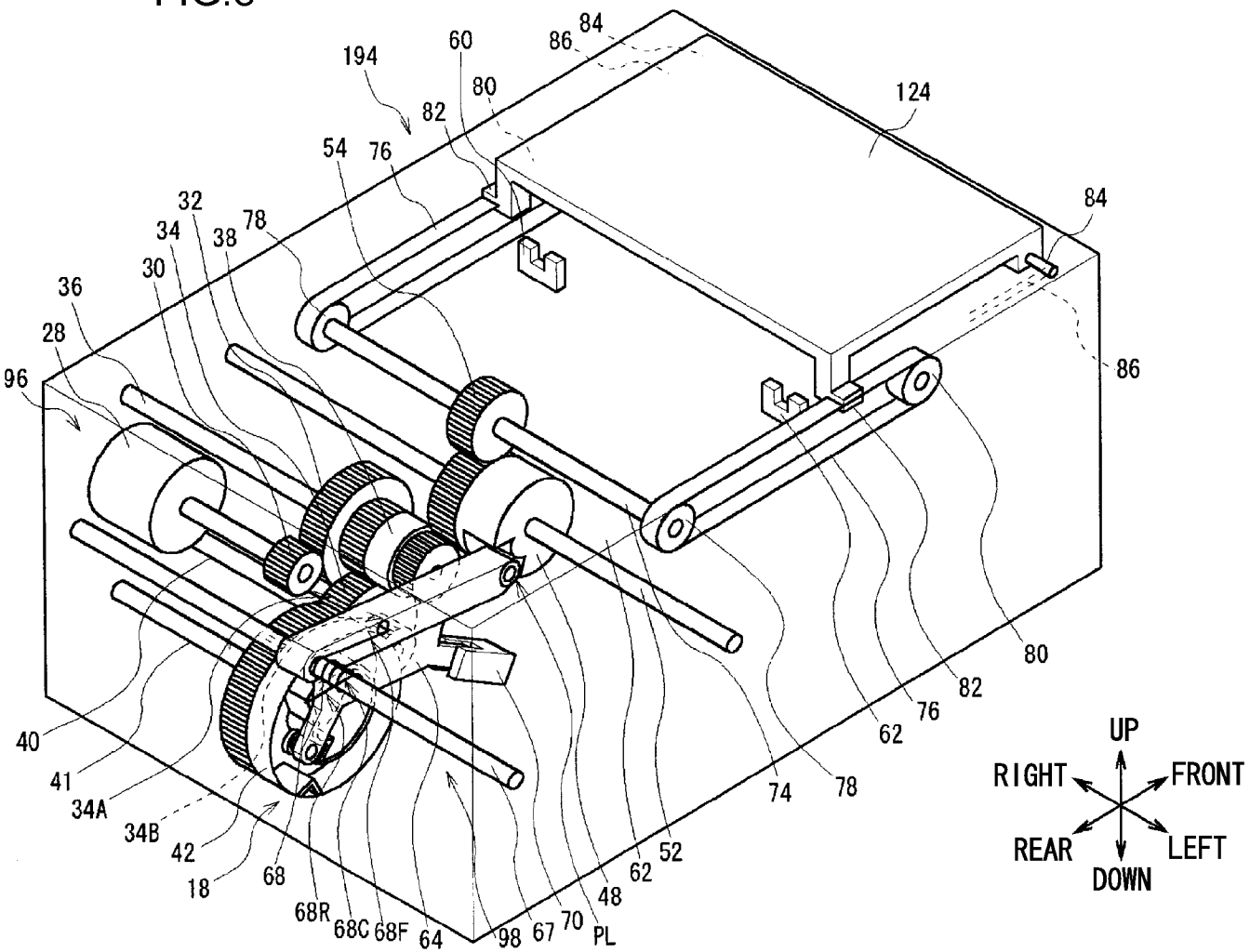
FIG. 8 is a perspective view showing the structure of a bill deposit/dispensing section in accordance with a second embodiment.

As compared with the automatic cash transaction device 1 in accordance with the first embodiment, the automatic cash transaction device 1 in accordance with the second embodiment is structured similarly except for a bill deposit/dispensing section 110 differing from the bill deposit/dispensing section 10, as shown in FIG. 8 in which the same reference numerals are given to portions corresponding to FIG. 3.

[2-1. Structure of Bill Deposit/Dispensing Section]

At the bill deposit/dispensing section 110, as compared with the bill deposit/dispensing section 10, an opening/closing section 194 differs from the opening/closing section 94. The opening/closing section 194 is structured from the drive gear 54, a drive gear shaft 74, drive pulleys 78, belts 76, and driven pulleys 80.

In front of and above the lock gear 48 at the bill deposit/dispensing section 110, the drive gear 54, that is cylindrical and at whose outer peripheral surface gear teeth are formed, has the drive gear shaft 74 inserted therethrough and fixed thereto as seen in side view such that the drive gear 54 meshes-together with this lock gear 48, and the drive gear 54 is provided so as to rotate together with the drive gear shaft 74. The left and right both ends of the drive gear shaft 74 are rotatably fixed to the frame 20.

Due to the drive gear 54 meshing-together with the lock gear portion 49 of the lock gear 48, rotational driving force from the motor 28 is transmitted to the drive gear 54.

At the left and right both ends of the drive gear shaft 74, the drive pulleys 78, that are cylindrical and at whose outer peripheral surfaces belt teeth are formed, are fixed to the drive gear shaft 74 such that the phases of the belt teeth thereof match.

The driven pulleys 80, that are cylindrical and at whose outer peripheral surfaces belt teeth are formed, are provided in front of the drive pulleys 78 so as to rotate freely around a shaft (not shown) that extends in the left-right direction.

The belts 76, that are endless belts and at whose inner peripheral surfaces are formed belt teeth that mesh-together with the belt teeth of the drive pulleys 78 and the belt teeth of the driven pulleys 80, are bridged between the outer peripheral surfaces of the drive pulleys 78 and the driven pulleys 80.

Due thereto, when the drive pulleys 78 rotate, the driving forces thereof are transmitted via the belts 76 to the driven pulleys 80, and these driven pulleys 80 rotate.

Shutter link portions 82 that project downward are formed at the left and right rear end portions of a shutter 124. These shutter link portions 82 are fixed to predetermined positions of the upper halves of the belts 76.

Further, guide rollers 84 that are cylindrical are provided so as to project-out in the leftward direction and the rightward direction, respectively, from the left and right side surfaces of the front end portion of the shutter 124.

Slide guides 86, in which are formed groove portions that run along the front-rear direction, are provided so as to be fixed to the frame 20 at the left and right both sides of the shutter 124. In FIG. 8, some of the slide guides 86 are omitted from illustration.

The shutter 124 is structured so as to be able to move in the front-rear direction along the slide guides 86 due to the guide rollers 84 being slidably fit into the groove portions of the slide guides 86.

[2-2. Operation and Effects]

In the above-described structure, at the time of opening the shutter 124 from the closed state (locked state), the bill deposit/dispensing section 110 rotates the motor 28 clockwise as seen in side view, on the basis of control of the control section.

Due to the driving force, that is due to this rotation, being successively transmitted to the post two-stage gear 32, the two-stage gear 34 and the cam gear 42 in the same way as at the bill deposit/dispensing section 10, the bill deposit/dispensing section 110 enters into the lock-free state.

When the motor 28 rotates further clockwise from the lock-free state in the closed state, this driving force is successively transmitted to the post two-stage gear 32, the idler gear 38, the lock gear 48, the drive gear 54 and the drive gear shaft 74, and thereby rotates the drive pulleys 78 counterclockwise.

Therefore, due to the belts 76 and the driven pulleys 80 rotating counterclockwise, the shutter 124 that is fixed to the belts 76 moves in the opening direction, and the bill deposit/dispensing section 110 enters into an open state.

On the other hand, at the time of closing the shutter 124 from the open state, the bill deposit/dispensing section 110 rotates the motor 28 counterclockwise as seen in side view, on the basis of control of the control section.

Due to the driving force, that is due to this rotation, being successively transmitted to the post two-stage gear 32, the idler gear 38, the lock gear 48, the drive gear 54 and the drive gear shaft 74, the drive pulleys 78 are rotated clockwise.

Therefore, due to the belts 76 and the driven pulleys 80 rotating clockwise, the shutter 124 that is fixed to the belts 76 moves in the closing direction, and the bill deposit/dispensing section 110 enters into the closed state.

At this time, due to the driving force of the motor 28 being successively transmitted to the post two-stage gear 32, the two-stage gear 34 and the cam gear 42 in the same way as at the bill deposit/dispensing section 10, the bill deposit/dispensing section 110 enters into the locked state.

In this way, at the bill deposit/dispensing section 110, the belts 76 are rotated by rotating the drive pulleys 78 and the driven pulleys 80 by using rotational driving force from the motor 28, and the shutter 124 that is fixed to the belts 76 is opened and closed.

Due thereto, not only in cases in which the shutter 24 is opened and closed by using the shutter racks 26 of the shutter 24 as in the bill deposit/dispensing section 10, but also in a structure in which the shutter 124 is opened and closed by using the belts 76 and the drive pulleys 78 and the driven pulleys 80, the bill deposit/dispensing section 110 can make it difficult to insert a tool in between the shutter 124 and the frame 20 from the exterior and access the lock anchoring position PL, and makes unlocking from the exterior difficult, and can prevent improper unlocking activity.

[3. Other Embodiments]

Note that the above-described embodiments describe cases in which driving force is transmitted from the motor 28, that is the same drive source, to the shutter opening/closing mechanism 16 and the shutter locking/unlocking mechanism 18, and the shutter 24 is opened and closed, and locking and unlocking of the shutter 24 are carried out.

The present invention is not limited to this, and a motor that transmits driving force to the shutter opening/closing mechanism 16, and a motor that transmits driving force to the shutter locking/unlocking mechanism 18, may be provided separately.

In this case, the post two-stage gear 32, the two-stage gear 34 and the idler gear 38 are omitted, and the motor gear 30 is made to contact the lock gear 48, and cam gear shaft 41 of the cam gear 42 is rotated by a motor other than the motor 28.

For example, at the time of opening the shutter, it suffices to open the shutter after releasing the locking, by starting rotation of the motor, that drives the lock gear 48 of the shutter opening/closing mechanism 16, after the elapsing of a predetermined period of time in which rotation of the motor that drives the cam gear 42 of the shutter locking/unlocking mechanism 18 is started.

Further, in the above-described embodiments, the rotational driving force of the motor 28 is transmitted to the cam gear 42 via the motor gear 30, the post two-stage gear 32 and the two-stage gear 34.

The present invention is not limited to this, and the cam gear 42 may be made to contact the motor gear 30 or the post two-stage gear 32, and rotational driving force of the motor 28 may be transmitted to the cam gear 42 from this motor gear 30 or post two-stage gear 32.

Moreover, the above-described embodiments describe cases in which the shutter 24 is disposed so as to cover the bill insertion/ejection opening 6 from the lower side of the bill insertion/ejection opening 6 (the inner side of the frame 20). The present invention is not limited to this, and a shutter may be disposed so as to cover the bill insertion/ejection opening 6 from the upper side of the bill insertion/ejection opening 6 (the outer side of the frame 20), and may slidingly move at the outer side of the frame 20.

Moreover, the above-described embodiments describe cases in which the shutters 24 and 124 are substantially flat plate shaped. The present invention is not limited to this, and the shutter may be a curved shaped. In short, it suffices for the shutter to be a shape that corresponds to the shape of the bill insertion/ejection opening 6 of the bill deposit/dispensing section 10.

Moreover, in the above-described first embodiment, the drive gear 54, the drive gear shaft 56 and the pinion gears 58 may be omitted, and the shutter 24 may be opened and closed due to the lock gear 48 of the lock gear 48 being made to mesh-together with the shutter racks 26 of the shutter 24.

Moreover, the above-described embodiments describe cases in which the lock gear 48 is rotated. The present invention is not limited to this, and the lock gear 48 may be moved reciprocally in the front-rear direction. In short, it suffices for the lock gear 48 to move so as to transmit the rotation from the idler gear 38 to the shutter 24, and for the lock gear 48 to be anchored on the lock portion 64 and movement restricted at the time of locking.

Moreover, in the above-described embodiments, by making the gear diameter of the lock gear portion 49 of the lock gear 48 be smaller than the gear diameter of the drive gear 54, and making the gear ratio of the lock gear 48 with respect to the drive gear 54 be small, it may be made such that the shutter 24 is difficult to be opened at the time when force is applied in the opening direction in order to open the shutter 24 that is in the closed state. In this case, the force by which the lock portion 64 restrains the lock gear 48 can be made to be small.

Moreover, the above-described embodiments describe cases in which the present invention is applied to the bill deposit/dispensing section 10 of the automatic cash transaction device 1 at which, in accordance with the contents of the transaction with a user, bills are deposited and bills are dispensed to the user. The present invention is not limited to this, and the present invention may be applied to various devices such as a bill depositing section that is used exclusively for deposits and in which bills are deposited, or a bill dispensing section that is used exclusively for dispensing and at which bills are dispensed, or the like.

Moreover, the above-described embodiments describe cases in which the present invention is applied to the bill deposit/dispensing section 10 of the automatic cash transaction device 1. The present invention is not limited to this, and the present invention may be applied to the coin deposit/dispensing section at the coin deposit/dispensing machine 5 of the automatic cash transaction device 1.

Further, the present invention is not limited to a coin deposit/dispensing section at which, in accordance with the contents of the transaction with a user, coins are deposited and coins are dispensed to the user. The present invention may be applied to various devices such as a coin depositing section that is used exclusively for deposits and in which coins are deposited, or a coin dispensing section that is used exclusively for dispensing and at which coins are dispensed, or the like.

In short, it suffices for there to be a device that drivingly opens and closes, and locks and unlocks, a shutter that moves in an opening direction of opening a media accommodating portion, that accommodates media, to the exterior, and a closing direction of closing the media accommodating portion from the exterior.

Moreover, in the above-described embodiments, the present invention is applied to the bill deposit/dispensing section 10 and 110 of the automatic cash transaction device 1 at which, in accordance with the contents of the transaction with a user, cash such as bills or the like is deposited and cash is dispensed to the user. However, the present invention is not limited to this, and can be applied to various types of devices having a mechanism into which paper-sheet-like media are inserted and that ejects paper-sheet-like media.

Moreover, although the above-described embodiments describe bills that serve as the media, the present invention is not limited to this, and it suffices for there to be thin, paper-like media such as, for example, gift certificates, cash vouchers, admission tickets, or the like.

Moreover, the present invention is not limited to the above-described first embodiment, second embodiment and other embodiments. Namely, the scope of application of the present invention extends as well to embodiments in which some of or all of the above-described embodiments and other embodiments are combined arbitrarily, and embodiments from which portions of the above-described embodiments and other embodiments have been extracted.

Moreover, the above-described embodiments describe cases in which the bill deposit/dispensing section 10 or 110 that serves as the shutter device is structured by the opening/closing section 94 or 194 that serves as the opening/closing section, the driving section 96 that serves as the driving section, the lock gear 48 that serves as the gear section, and the shutter locking/unlocking section 98 that serves as the shutter locking/unlocking section.

The present invention is not limited to this, and the shutter device may be structured by an opening/closing section, a driving section, a gear section and a shutter locking/unlocking section of any of various other structures.

Moreover, the above-described embodiments describe cases in which the automatic cash transaction device 1 that serves as the media transaction device is structured by the customer interface section 9 that serves as a reception section, the opening/closing section 94 or 194 that serves as the opening/closing section, the driving section 96 that serves as the driving section, the lock gear 48 that serves as the gear section, the shutter locking/unlocking section 98 that serves as the shutter locking/unlocking section, and the conveying path 15 that serves as the conveying section.

The present invention is not limited to this, and the media transaction device may be structured by a reception section, an opening/closing section, a driving section, a gear section, a shutter locking/unlocking section, and a conveying section of any of various other structures.

Industrial Applicability

The present invention can be utilized in a bill deposit/dispensing section that is provided in an automatic cash transaction device or the like, and into which a user inserts bills to be deposited, and from which bills to be dispensed are ejected-out to a user.

The disclosure of Japanese Patent Application No. 2012-287864 that was filed on Dec. 28, 2012 is, in its entirety, incorporated by reference into the present specification.

The invention claimed is:

1. A shutter device comprising:

an opening/closing section that moves a shutter in an opening direction of opening, to an exterior, a media accommodating portion, which accommodates media that have been taken from the exterior via an opening, and in a closing direction of closing the media accommodating portion off from the exterior;

a driving section that has driving force;

a gear section that drives the opening/closing section by transmitting driving force from the driving section to the opening/closing section by contacting the driving section and the opening/closing section and rotating; and a shutter locking/unlocking section that, by contacting the gear section and restricting rotation, restricts operation of the opening/closing section and locks the shutter that is in a closed state, and, on the other hand, by coming apart from the gear section, makes the opening/closing section able to operate and releases locking of the shutter, the shutter locking/unlocking section including a cam gear receiving a transmission thereto of the driving force from the driving section so as to be driven into rotation, and a lock portion having one portion contacting the cam gear and another portion anchored on the gear section, so as to restrict rotation of the gear section, and, on the other hand, so as to make the gear section rotatable by rotating in accordance with rotation of the cam gear and said other portion accordingly coming apart from the gear section.

2. The shutter device of claim 1, wherein:

racks are formed at the shutter at places that face the opening/closing section; and the opening/closing section includes pinion gears at whose outer peripheral surfaces gear teeth are formed, and moves the shutter by meshing-together with the racks of the shutter and rotating.

3. The shutter device of claim 1, wherein the opening/closing section has a plurality of pulleys that are rotatable, and endless belts that are bridged between the pulleys so as to extend along a moving direction of the shutter and to which the shutter is fixed, and the opening/closing section moves the shutter due to the endless belts rotating accompanying rotation of the pulleys.

4. The shutter device of claim 1, wherein an operation portion that rotates the cam gear manually is formed at the cam gear.

5. The shutter device of claim 1, wherein driving force from the driving section is not transmitted to the shutter locking/unlocking section, and driving force is transmitted to the shutter locking/unlocking section from a locking/unlocking driving section that drives the shutter locking/unlocking section and that is different than a drive source that generates driving force at the driving section.

6. The shutter device of claim 1, wherein:

the gear section includes a lock gear having a lock anchor portion that is substantially cylindrical and at which a portion of an outer peripheral surface is recessed; and the lock portion restricts rotation of the lock gear due to a lock rotating member, that moves rollingly, anchoring on the lock anchor portion at the lock gear.

7. The shutter device of claim 6, wherein:

the cam gear includes a cam portion that is substantially circular and at which is formed a releasing link sliding portion at which a portion of an outer peripheral surface is recessed toward an inner periphery; and the lock portion makes the lock gear rotatable due to a lock releasing rotating member, that contacts the releasing link sliding portion and can move rollingly, rotating by moving toward an outer peripheral surface of the cam portion accompanying rotation of the cam gear, and the lock rotating member coming apart from the lock anchor portion at the lock gear.

8. The shutter device of claim 7, wherein the driving section includes a plurality of gears that are rotatable, and is structured at a gear ratio at which the cam gear rotates approximately one rotation at a time when the shutter moves from an open state to a closed state.

9. A media transaction device comprising:

a reception section that receives transactions relating to paper-sheet-like media;

an opening/closing section that moves a shutter in an opening direction of opening, to an exterior, a media accommodating portion, which accommodates media that have been taken from the exterior via an opening, and in a closing direction of closing the media accommodating portion off from the exterior;

a driving section that has driving force;

a gear section that drives the opening/closing section by transmitting driving force from the driving section to the opening/closing section by contacting the driving section and the opening/closing section and rotating;

a shutter locking/unlocking section that, by contacting the gear section and restricting rotation, restricts operation of the opening/closing section and locks the shutter that is in a closed state, and, on the other hand, by coming apart from the gear section, makes the opening/closing section able to operate and releases locking of the shutter, the shutter locking/unlocking including a cam gear receiving a transmission thereto of the driving force from the driving section so as to be driven into rotation, and a lock portion having one portion contacting the cam gear and another portion anchored on the gear section, so as to restrict rotation of the gear section, and, on the other hand, so as to make the gear section rotatable by rotating in accordance with rotation of the cam gear and said other portion accordingly coming apart from the gear section; and a conveying section that conveys the media that were received by the reception section and accommodated in the media accommodating portion.

10. A shutter device comprising:

an opening/closing section that moves a shutter in an opening direction of opening, to an exterior, a media accommodating portion, which accommodates media that have been taken from the exterior via an opening, and in a closing direction of closing the media accommodating portion off from the exterior;

a driving section that has driving force;

a gear section that drives the opening/closing section by transmitting driving force from the driving section to the opening/closing section by contacting the driving section and the opening/closing section and rotating; and a shutter locking/unlocking section that, by contacting the gear section and restricting rotation, restricts operation of the opening/closing section and locks the shutter that is in a closed state, and, on the other hand, by coming apart from the gear section, makes the opening/closing section able to operate and releases locking of the shutter, wherein driving force from the driving section is not transmitted to the shutter locking/unlocking section, and driving force is transmitted to the shutter locking/unlocking section from a locking/unlocking driving section that drives the shutter locking/unlocking section and that is different than a drive source that generates driving force at the driving section.

* * * * *